US007438608B2

(12) United States Patent
Hung

(10) Patent No.: US 7,438,608 B2
(45) Date of Patent: Oct. 21, 2008

(54) SOCKET CONNECTOR AND FEMALE TERMINAL THEREIN

(75) Inventor: fute Hung, Chang Hwa (TW)

(73) Assignee: K.S. Terminals, Inc., Chang Hwa (TW)

( * ) Notice: Subject to any disclaimer, the term of this patent is extended or adjusted under 35 U.S.C. 154(b) by 0 days.

(21) Appl. No.: 12/003,460

(22) Filed: Dec. 26, 2007

(65) Prior Publication Data

US 2008/0188142 A1 Aug. 7, 2008

Related U.S. Application Data

(63) Continuation of application No. 11/730,110, filed on Mar. 29, 2007, now Pat. No. 7,387,549.

(51) Int. Cl.
*H01R 11/22* (2006.01)

(52) U.S. Cl. ..... 439/851

(58) Field of Classification Search ..... 439/842–845, 439/847–848, 851–856, 861–862, 885, 857, 439/858, 816, 880, 849; 29/885, 884, 874
See application file for complete search history.

(56) References Cited

U.S. PATENT DOCUMENTS

| | | | |
|---|---|---|---|
| 4,148,547 | A | 4/1979 | Otsuki et al. |
| 4,461,531 | A | 7/1984 | Davis et al. |
| 4,750,897 | A | 6/1988 | Neidecker |
| 5,033,982 | A | 7/1991 | Lucas |
| 5,147,230 | A | 9/1992 | Plyler et al. |
| 5,186,663 | A | 2/1993 | Wymelenberg |
| 5,326,288 | A | 7/1994 | Lu et al. |
| 5,338,229 | A | 8/1994 | Egenolf |
| 5,340,337 | A | 8/1994 | Pentz |
| 5,658,175 | A | 8/1997 | Muzslay |
| 5,667,413 | A | 9/1997 | Trafton |
| 5,720,634 | A | 2/1998 | Sten |
| 5,775,960 | A | 7/1998 | Saito et al. |
| 5,820,423 | A | 10/1998 | Hsu |
| 5,921,822 | A | 7/1999 | Kennedy et al. |
| 5,951,338 | A | 9/1999 | Seko et al. |
| 6,010,377 | A | 1/2000 | Dechelette et al. |

(Continued)

*Primary Examiner*—Edwin A. León
(74) *Attorney, Agent, or Firm*—Reed Smith LLP; Stanley P. Fisher, Esq.; Juan Carlos A. Marquez, Esq.

(57) ABSTRACT

This invention discloses a novel socket connector and female terminals therein. The female terminal has a contact portion and an attachment portion. The attachment portion is set to attach to a wire core, while the contact portion is set to permit a pin to plug in and contact conductively. A neck with a smaller diameter is provided between the contact portion and the attachment portion. The contact portion comprises an outer barrel and an inner tube having a plurality of spring elements extending axially. Each spring element has a biasing section toward the inner tube axis near the plug-in entrance for matching the contact pin. The other side of the spring element distant from the biasing section is connected to the inner tube. The inner tube and the outer barrel are made of a metal sheet in one-piece construction while the inner tube is connected to the neck at one end and connected to the outer barrel via the folded part at the opposite side. The outer barrel is shorter than the inner tube. A diameter shrinking part is further provided with the outer barrel near the contact pin plug-in entrance for improving the assembly to the socket connector.

22 Claims, 7 Drawing Sheets

U.S. PATENT DOCUMENTS 6,042,432 A 3/2000 Hashizawa et al.
6,152,587 A 11/2000 Berg
6,254,439 B1 7/2001 Endo et al.
6,358,104 B2 3/2002 Daugherty et al.
6,450,843 B1 * 9/2002 Heimuller ..... 439/852
6,752,668 B2 * 6/2004 Koch, Jr. ..... 439/843

* cited by examiner

SOCKET CONNECTOR AND FEMALE TERMINAL THEREIN

CROSS REFERENCE TO RELATED APPLICATIONS

This application is a Continuation of U.S. application Ser. No. 11/730,110 filed on Mar. 29, 2007 now U.S. Pat. No. 7,387,594. Priority is claimed based upon U.S. application Ser. No. 11/730,110 filed on Mar. 29, 2007, which claims priority from R.O.C. Patent Application No. 096103655, filed on Feb. 1, 2007, all of which is incorporated herein by reference in its entirety.

BACKGROUND OF THE INVENTION

1. Technical Field

The present invention relates to a terminal for being installed in an isolating housing to form an assembled electrical socket connector and, more particularly, to a female terminal that is made of metal and set to permit a slender pin to plug in and contact conductively.

2. Description of Related Art

Electrical socket connector is known as an indispensable part for connecting multi-core cables of 3C products and household appliances for signal communication. Conventional electrical socket connectors can be principally classified into either male connectors or socket connectors. A male connector typically comprises a plurality of pins and a socket connector typically comprises a plurality of terminals corresponding to said plural of pins so as to permit the pins of the male connector to plug in and contact conductively.

Compared with a male connector, a socket connector requires a more complex manufacturing technique. The critical component of such socket connector is the terminals therein, which preferably have small-volume; provide guide function to the pin that are to be plugged in; and provide appropriate clamp force to ensure the connection and conduction between the terminals and the pins plugged therein. Thus, a terminal made of a metal sheet in one-piece construction has become the main stream of the development of the art.

In prior arts, U.S. Pat. No. 5,720,634 discloses a female terminal formed in one-piece construction. In such prior-art female terminal, an inner tube and an outer barrel are provided at the portion in contact with a pin, wherein the outer barrel is connected to a neck of the female terminal, while the inner tube is formed by folding a metal sheet inwardly within the outer barrel. The inner tube is substantially composed of a plurality of spring elements bent with a mold in order to clamp a pin. Since the spring elements are formed as cantilevers, the inner tube is with only one end folded as a round gateway while the opposite end is opened as a free end, and thus full control of configuration of such prior-art female terminal is difficult to achieve.

In prior arts, U.S. Pat. No. 6,152,787 also provides a female terminal formed in one-piece construction. In such prior-art female terminal, an inner tube and an outer barrel are provided at the portion in contact with a pin, wherein the inner tube is connected to a neck of the female terminal, while the outer barrel is formed by folding a metal sheet to enclose the inner tube. The inner tube is substantially composed of a plurality of spring elements bent with a mold in order to clamp a pin. Since the spring elements are formed as cantilevers, the inner tube is with only one end folded as a round gateway while the opposite end is opened as a free end, and thus full control of configuration of such prior-art female terminal is difficult to achieve. Actually, the configurations of U.S. Pat. No. 6,152,787 and U.S. Pat. No. 5,720,634 are very similar. The only difference therebetween is that U.S. Pat. No. 5,720,634 has the outer barrel connected to the neck of the female terminal and the inner tube is formed by folding a metal sheet inwardly within the outer barrel, while U.S. Pat. No. 6,152,787 has the inner tube connected to the neck of the female terminal, while the outer barrel is formed by folding a metal sheet to enclose the inner tube.

Further, in prior arts, U.S. Pat. No. 6,358,104 discloses another female terminal formed in one-piece construction. In such prior-art female terminal, an inner tube and an outer barrel are provided at the portion in connection with a pin wherein the inner tube is connected to a neck of the female terminal, while the outer barrel is formed by folding a metal sheet to enclose the inner tube. A plurality of spring elements are deposited in the inner tube and each of the spring elements has a wavy profile in the middle portion thereof. Thereby, when the inner tube is later bent into a shape of a round gateway by a mold, the wavy portion of each said spring element leans toward the inner tube axis automatically under the bending force so as to provide a clamp force to a plugged pin. Meantime, as the U.S. Pat. No. 6,358,104 has both ends of the inner tube formed as round gateways by bending a metal sheet, both ends are not shaped as cantilevers. Thus, compared with U.S. Pat. No. 6,152,787 and U.S. Pat. No. 5,720,634, it achieves superior structure strength.

SUMMARY OF THE INVENTION

To provide a terminal that possesses superior structure strength and can be manufactured more easily so as to remedy foresaid shortcomings of the prior arts, the present invention discloses a novel electrical socket connector and female terminals therein. The female terminal has a contact portion and an attachment portion. The attachment portion is set to attach to a wire core, while the contact portion is set to permit a pin to plug in and contact conductively. A neck with a smaller diameter is provided between the contact portion and the attachment portion. The contact portion comprises an outer barrel and an inner tube having a plurality of spring elements extending axially. Each spring element has a biasing section toward the inner tube axis near the plug-in entrance for matching the contact pin. The other side of the spring element distant from the biasing section is connected to the inner tube. The inner tube and the outer barrel are made of a metal sheet in one-piece construction, while the outer barrel is connected to the neck at one end and connected to the inner tube via the folded part at the opposite side. The inner tube is shorter than the outer barrel in order to be accommodated in the outer barrel. A diameter shrinking part is further provided with the outer barrel near the contact pin plug-in entrance for improving the assembly to the socket connector.

Thus, it is one objective of the present invention to provide a female terminal in a socket connector that provides superior clamp force.

It is another objective of the present invention to provide a female terminal in a socket connector that can be manufactured more easily.

It is a further objective of the present invention to provide a female terminal in a socket connector that possesses superior structure strength.

It is still another objective of the present invention to provide a socket connector that is equipped with plural female terminals that provide superior clamp force.

It is yet another objective of the present invention to provide a socket connector that is equipped with plural female terminals that can be manufactured more easily.

It is an additional objective of the present invention to provide a socket connector that is equipped with female terminals that possess superior structure strength.

BRIEF DESCRIPTION OF THE DRAWINGS

The invention as well as a preferred mode of use, further objectives and advantages thereof, will be best understood by reference to the following detailed description of an illustrative embodiment when read in conjunction with the accompanying drawings, wherein.

DETAILED DESCRIPTION OF THE PREFERRED EMBODIMENTS

The present invention is directed to a female terminal of a socket connector. Those of ordinary skill in the art will appreciate that the principle of the connection and conduction between the female terminal and a male terminal of the socket connector is well known and need not be discussed in great details herein. Furthermore, the accompanying drawings are provided for schematically showing the structural characters of the present invention and are not necessarily drawn to scale.

Figure 1A:
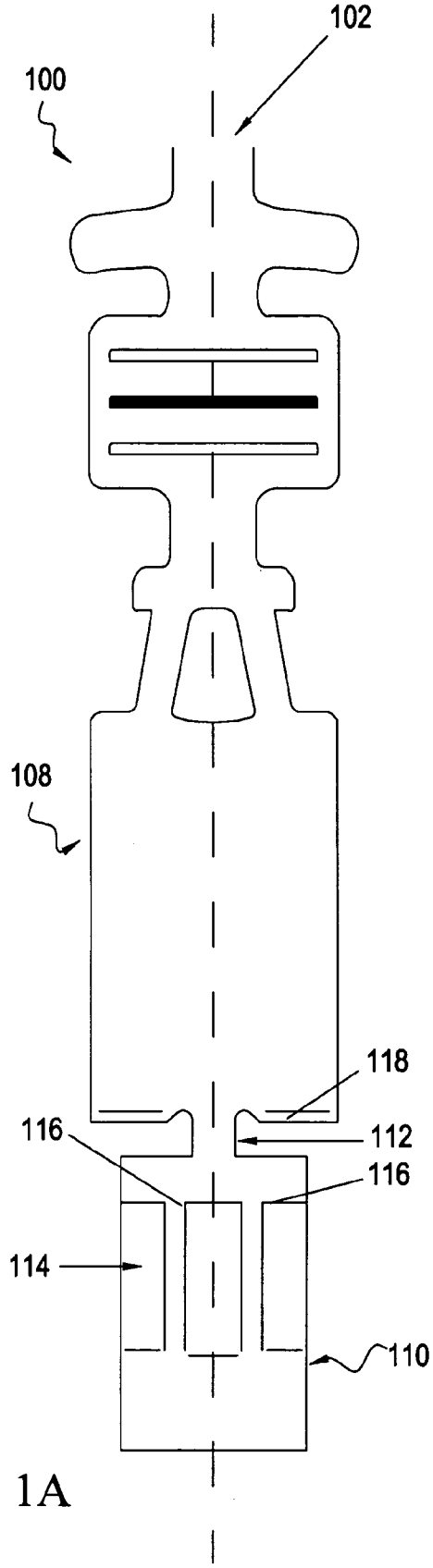
FIG. 1A is an expanded view of the female terminal of a socket connector according to a first preferred embodiment of the present invention.
Figure 1B:
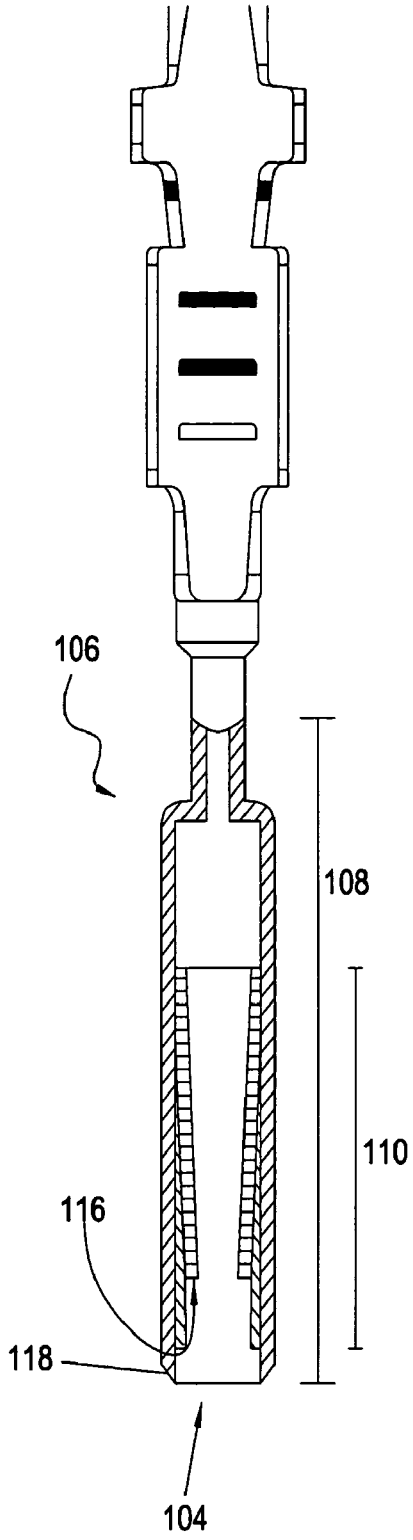
FIG. 1B is a cross sectional view of the configured female terminal of the socket connector according to the first preferred embodiment of the present invention.

Please firstly refer to FIGS. 1A and 1B for a first preferred embodiment of the present invention. In can be seen in the drawings that the disclosed female terminal 100 primarily comprises an attachment portion 102, a contact portion 104, a neck 106, an outer barrel 108, an inner tube 110, a folded part 112, a plurality of spring elements 114, a plurality of biasing sections 116 and a diameter shrinking part 118.

The female terminal 100 is formed in one-piece construction by pressing a metal sheet in a mold and has the contact portion 104, the attachment portion 102 distant from the contact portion 104, and the neck 106 for joining the contact portion 104 and the attachment portion 102. The attachment portion 102 functions for connecting a conductive wire while the contact portion 104 permits a slender pin to plug in, so as to connect and clamp the pin and establish conductive communication with the pin. The inner tube 110 of the contact portion 104 has a plurality of spring elements 114 extending axially. Each of the spring elements 114 has the end distant from biasing section 116 connected to the inner wall of the inner tube 110, and has the end near the biasing section 116 separated from the inner wall of the inner tube 110 with a slit. Alternatively, said slit may be further extended into the form of an opening. Since the spring element 114 is separated from the inner tube 110 with the slit, the portion thereof near the entrance of the contact portion 104 becomes a free end, which can be firstly formed as the biasing section 116 toward the inner tube axis by a tool, so that after a pin is plugged into the female terminal 100, the biasing section 116 can provide appropriate guide function and clamp force to the pin.

Foresaid plural spring elements 114, the inner tube 110 and outer barrel 108 are formed as one piece from a single metal sheet by means of, for instance, pressing method. The outer barrel 108 has one end connected with the neck 106 directly and has the opposite end connected with the inner tube 110 via the folded part 112. The inner tube 110 is shorter than the outer barrel 108 in order to be accommodated in the outer barrel 108. A diameter shrinking part 118 is further provided with the outer barrel 108 and contact portion 104 near the contact pin plug-in entrance for improving the assembly to the socket connector.

In addition to the strip shape, the spring element 114 can also be formed into a trapezoid shape with one end broader that the opposite end or a shape with middle concaved profile as long as the portion thereof near the entrance of the contact portion 104 can become the free end, which can be formed as a biasing section 116 facing toward the inner tube axis so as to provide appropriate guide function and clamp force to the pin. Hence, on the spring element 114, the biasing section 116 may be wider than the two ends connected to the inner tube 110. Alternatively, the biasing section 116 may be narrower than the two ends connected to the inner tube 110. Further, for providing preferable guide function and clamp force to pins of varied lengths, the amount of the spring elements 114 is preferably 3, which achieves better effect of guidance and balance. Nevertheless, the amount of the spring elements 114 can be 2 or other amount in consideration of special limitation or the size of the pin.

Figure 2:
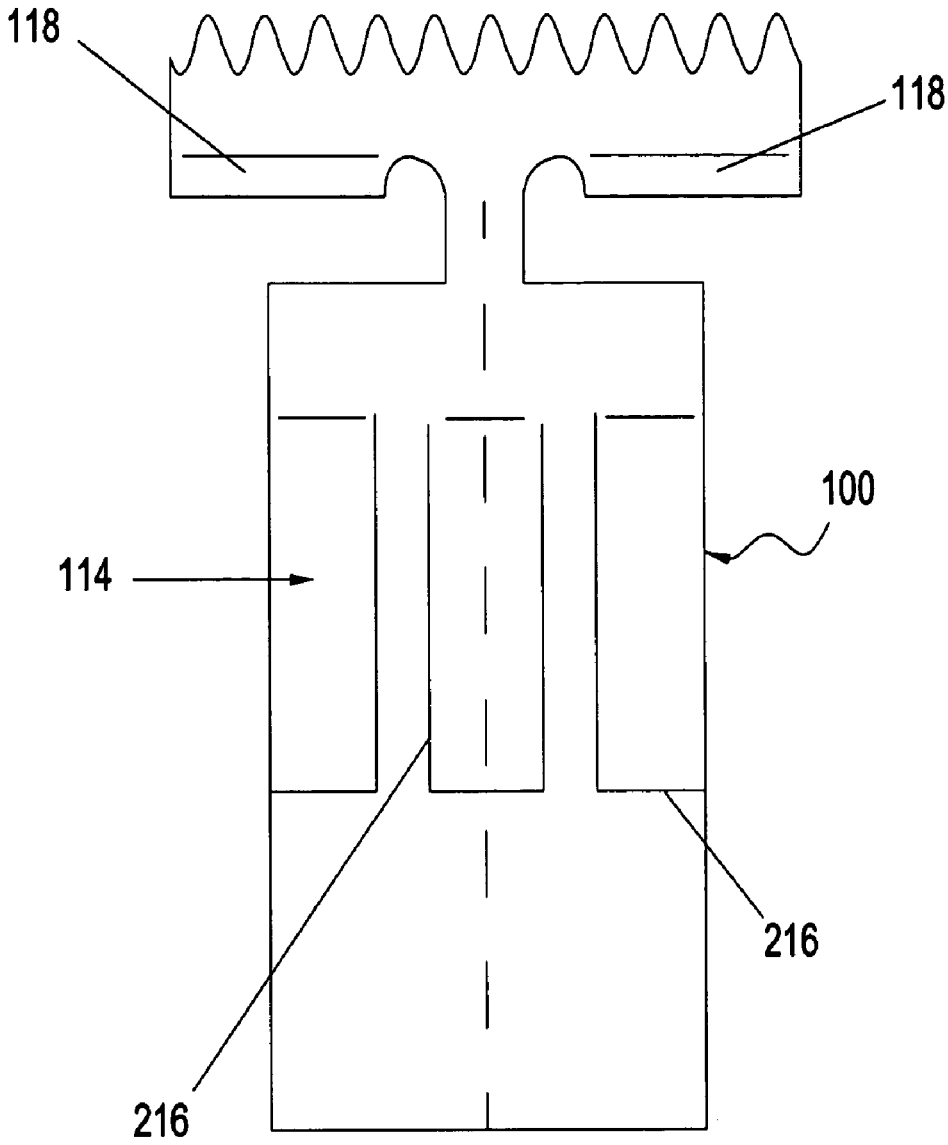
FIG. 2 is a partial exploded view of the female terminal of a socket connector according to a second preferred embodiment of the present invention.

Please refer to FIG. 2 for a second preferred embodiment of the present invention. In can be seen in the drawing that the disclosed female terminal 100 primarily comprises an attachment portion 102, a contact portion 104, a neck 106, an outer barrel 108, an inner tube 110, a folded part 112, a plurality of spring elements 114, a plurality of biasing sections 216 and a diameter shrinking part 118.

The female terminal 100 is formed in one-piece construction by pressing a metal sheet in a mold and has the contact portion 104, the attachment portion 102 distant from the contact portion 104, and the neck 106 for joining the contact portion 104 and the attachment portion 102. The attachment portion 102 functions for connecting a conductive wire, while the contact portion 104 permits a slender pin to plug in so as to connect and clamp the pin and establish conductive communication with the pin. The inner tube 110 of the contact portion 104 has a plurality of spring elements 114 extending axially. Each of the spring elements 114 has the end distant from the biasing section 216 connected to the inner wall of the inner tube 110, and has the end near the biasing section 216 separated from the inner wall of the inner tube 110 with a slit. Alternatively, said slit may be further extended into the form of an opening. Since the spring element 114 is separated from the inner tube 110 with the slit, the portion thereof distant from the entrance of the contact portion 104 becomes a free end, which can be firstly formed as the biasing section 216 facing toward the inner tube axis by a tool, so that after a pin is plugged into the female terminal 100, the biasing section 216 can provide appropriate guide function and clamp force to the pin.

Foresaid plural spring elements 114, the inner tube 110 and outer barrel 108 are formed as one piece from a single metal sheet by means of, for instance, pressing method. The outer barrel 108 has one end connected with the neck 106 directly and has the opposite end connected with the inner tube 110 via a folded part 112. The inner tube 110 is shorter than the outer barrel 108 in order to be accommodated in the outer barrel 108. A diameter shrinking part 118 is further provided with the outer barrel 108 and the contact portion 104 near the contact pin plug-in entrance for improving the assembly to the socket connector.

In addition to the strip shape, the spring element 114 can be also formed into a trapezoid shape with one end broader that the opposite end or a shape with middle concaved profile as long as the portion thereof distant from the entrance of the contact portion 104 can become the free end, which can be formed as a biasing section 216 facing toward the inner tube axis so as to provide appropriate guide function and clamp force to the pin. Hence, on the spring element 114, the biasing section 216 may be wider than the two ends connected to the inner tube 110. Alternatively, the biasing section 216 may be narrower than the two ends connected to the inner tube 110. Further, for providing preferable guide function and clamp force to pins of varied lengths, the amount of the spring elements 114 is preferably 3, which achieves better effect of guidance and balance. Nevertheless, the amount of the spring elements 114 can be 2 or other amount in consideration of special limitation or the size of the pin.

Figure 3:
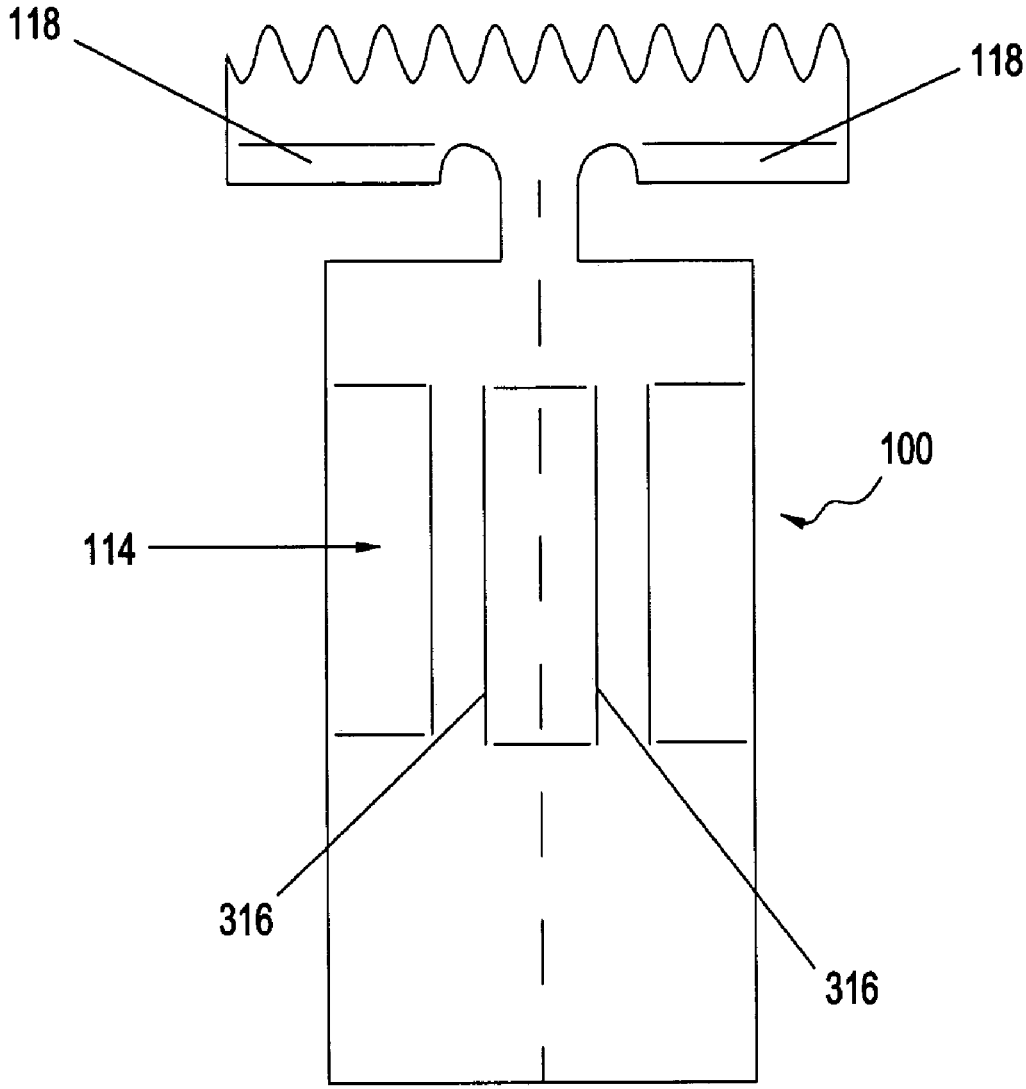
FIG. 3 is a partial expanded view of the female terminal of a socket connector according to a third preferred embodiment of the present invention.

Please refer to FIG. 3 for a third preferred embodiment of the present invention. In can be seen in the drawing that the disclosed female terminal 100 primarily comprises an attachment portion 102, a contact portion 104, a neck 106, an outer barrel 108, an inner tube 110, a folded part 112, a spring element 114, a biasing section 316 and a diameter shrinking part 118.

The female terminal 100 is formed in one-piece construction by pressing a metal sheet in a mold and has the contact portion 104, the attachment portion 102 distant from the contact portion 104, and the neck 106 for joining the contact portion 104 and the attachment portion 102. The attachment portion 102 functions for connecting a conductive wire, while the contact portion 104 permits a slender pin to plug in so as to connect and clamp the pin and establish conductive communication with the pin. The inner tube 110 of the contact portion 104 has a plurality of spring elements 114 extending axially. Each of the spring elements 114 has the end near the entrance of the contact portion 104 and the end distant from the entrance of the contact portion 104 connected to the inner wall of the inner tube 110, and has the opposite sides separated from the inner wall of the inner tube 110 with a slit respectively. Alternatively, each said slit may be further extended into the form of an opening. Since the opposite sides of the spring elements 114 are not connected to the inner tube 110, the middle portions of the spring elements 114 can provide relatively better elasticity and deformability. The middle portions of the spring elements 114 may be firstly formed as biasing sections 316 facing toward the inner tube axis by a tool, so that after a pin is plugged into the female terminal 100, the biasing sections 316 can provide appropriate guide function and clamp force to the pin.

Foresaid plural spring elements 114, the inner tube 110 and outer barrel 108 are formed as one piece from a single metal sheet by means of, for instance, pressing method. The outer barrel 108 has one end connected with the neck 106 directly and has the opposite end connected with the inner tube 110 via a folded part 112. The inner tube 110 is shorter than the outer barrel 108 in order to be accommodated in the outer barrel 108. A diameter shrinking part 118 is further provided with the outer barrel 108 and the contact portion 104 near the contact pin plug-in entrance for improving the assembly to the socket connector.

In addition the strip shape, the spring element 114 can also be formed into a trapezoid shape with one end broader that the opposite end or a shape with middle concaved profile as long as a biasing section 316 facing toward the inner tube axis can be formed at the middle portion of the spring element 114 so as to provide appropriate guide function and clamp force to the pin. Hence, on the spring element 114, the biasing section 316 may be wider than the two ends connected to the inner tube 110. Alternatively, the biasing section 316 may be narrower than the two ends connected to the inner tube 110. Further, for providing preferable guide function and clamp force to pins in varied lengths, the amount of the spring elements 114 is preferably 3, which achieves better effect of guidance and balance. Nevertheless, the amount of the spring elements 114 can be 2 or other amount in consideration of special limitation or the size of the pin.

Figure 4:
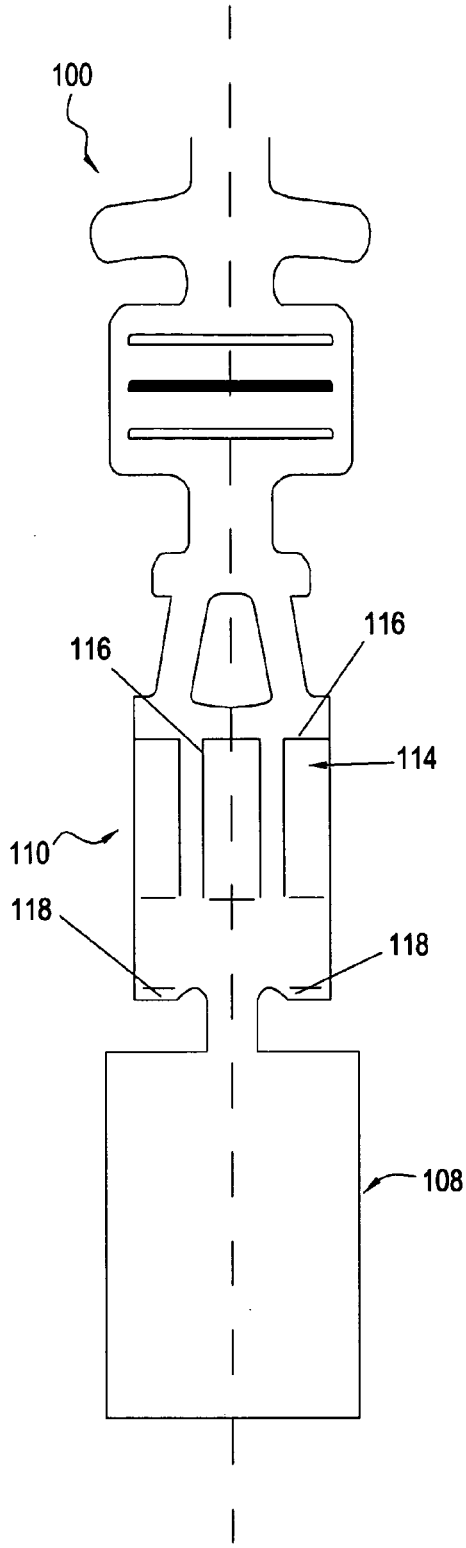
FIG. 4 is a partial expanded view of the female terminal of a socket connector according to a fourth preferred embodiment of the present invention.

Please refer to FIG. 4 for a fourth preferred embodiment of the present invention. In can be seen in the drawing that the disclosed female terminal 100 primarily comprises an attachment portion 102, a contact portion 104, a neck 106, an outer barrel 108, an inner tube 110, a folded part 112, a plurality of spring elements 114, a plurality of biasing sections 116 and a diameter shrinking part 118.

The female terminal 100 is formed in one-piece construction by pressing a metal sheet in a mold and has the contact portion 104, the attachment portion 102 distant from the contact portion 104, and the neck 106 for joining the contact portion 104 and the attachment portion 102. The attachment portion 102 functions for connecting a conductive wire, while the contact portion 104 permits a slender pin to plug in so as to connect and clamp the pin and establish conductive communication with the pin. The inner tube 110 of the contact portion 104 has a plurality of spring elements 114 extending axially. Each of the spring elements 114 has the end distant from the biasing section 116 connected to the inner wall of the inner tube 110, and has the end near the biasing section 116 separated from the inner wall of the inner tube 110 with a slit. Alternatively, said slit may be further extended into the form of an opening. Since the spring element 114 is separated from the inner tube 110 with the slit, the portion thereof near the entrance of the contact portion 104 becomes a free end, which can be firstly formed as a biasing section 116 facing toward the inner tube axis by a tool, so that after a pin is plugged into the female terminal 100, the biasing section 116 can provide appropriate guide function and clamp force to the pin.

Foresaid plural spring elements 114, the inner tube 110 and outer barrel 108 are formed as one piece from a single metal sheet by means of, for instance, pressing method. The inner tube 110 has one end connected with the neck 106 directly and has the opposite end connected with the outer barrel 108 via a folded part 112. The outer barrel 108 is shorter than the inner tube 110. A diameter shrinking part 118 is further provided with the outer barrel 108 and the contact portion 104 near the contact pin plug-in entrance for improving the assembly to the socket connector.

In addition the strip shape, the spring element 114 can be also formed into a trapezoid shape with one end broader that the opposite end or a shape with middle concaved profile as long as the portion thereof near the entrance of the contact portion 104 can become the free end, which can be formed as a biasing section 116 facing toward the inner tube axis so as to provide appropriate guide function and clamp force to the pin. Hence, on the spring element 114, the biasing section 116 may be wider than the two ends connected to the inner tube 110. Alternatively, the biasing section 116 may be narrower than the two ends connected to the inner tube 110. Further, for providing preferable guide function and clamp force to pins of varied lengths, the amount of the spring elements 114 is preferably 3, which achieves better effect of guidance and balance. Nevertheless, the amount of the spring elements 114 can be 2 or other amount in consideration of special limitation or the size of the pin.

Figure 5:
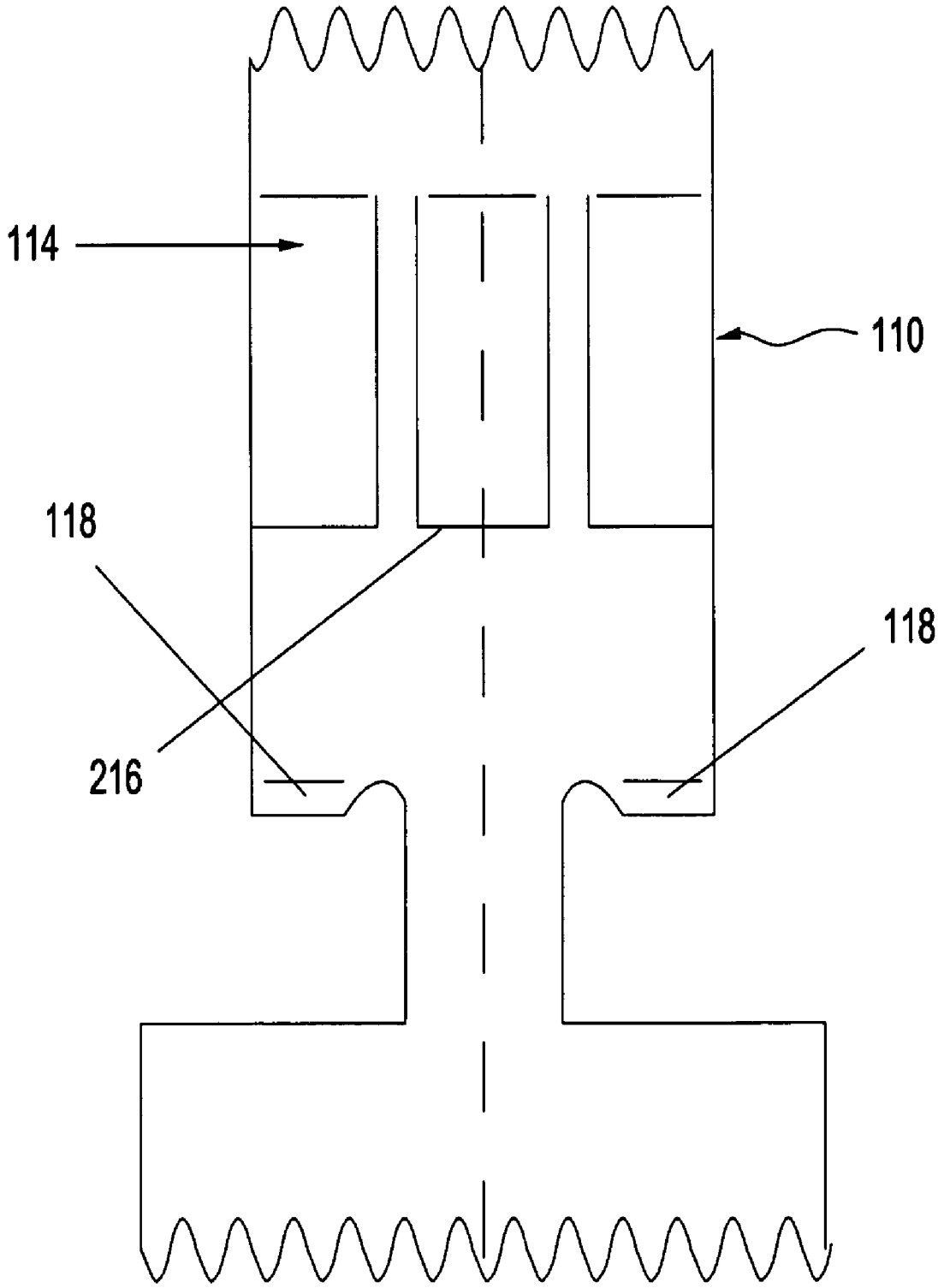
FIG. 5 is a partial expanded view of the female terminal of a socket connector according to a fifth preferred embodiment of the present invention.

Please refer to FIG. 5 for a fifth preferred embodiment of the present invention. In can be seen in the drawing that the disclosed female terminal 100 primarily comprises an attachment portion 102, a contact portion 104, a neck 106, an outer barrel 108, an inner tube 110, a folded part 112, a plurality of spring elements 114, a plurality of biasing sections 216 and a diameter shrinking part 118.

The female terminal 100 is formed in one-piece construction by pressing a metal sheet in a mold and has the contact portion 104, the attachment portion 102 distant from the contact portion 104, and the neck 106 for joining the contact portion 104 and the attachment portion 102. The attachment portion 102 functions for connecting a conductive wire, while the contact portion 104 permits a slender pin to plug in so as to connect and clamp the pin and establish conductive communication with the pin. The inner tube 110 of the contact portion 104 has a plurality of spring elements 114 extending axially. Each of the spring elements 114 has the end distant from the biasing section 216 connected to the inner wall of the inner tube 110, and has the end near the biasing section 216 separated from the inner wall of the inner tube 110 with a slit. Alternatively, said slit may be further extended into the form of an opening. Since the spring element 114 is separated from the inner tube 110 with the slit, the portion thereof distant from the entrance of the contact portion 104 becomes a free end, which can be firstly formed as the biasing section 216 facing toward the inner tube axis by a tool, so that after a pin is plugged into the female terminal 100, the biasing section 216 can provide appropriate guide function and clamp force to the pin.

Foresaid plural spring elements 114, the inner tube 110 and outer barrel 108 are formed as one piece from a single metal sheet by means of, for instance, pressing method. The inner tube 110 has one end connected with the neck 106 directly and has the opposite end connected with the outer barrel 108 via a folded part 112. The outer barrel 108 is shorter than the inner tube 110. A diameter shrinking part 118 is further provided with the outer barrel 108 and the contact portion 104 near the contact pin plug-in entrance for improving the assembly to the socket connector.

In addition the strip shape, the spring element 114 can be also formed into a trapezoid shape with one end broader that the opposite end or a shape with middle concaved profile as long as the portion thereof distant from the entrance of the contact portion 104 can become the free end, which can be formed as a biasing section 216 facing toward the inner tube axis so as to provide appropriate guide function and clamp force to the pin. Hence, on the spring element 114, the biasing section 216 may be wider than the two ends connected to the inner tube 110. Alternatively, the biasing section 216 may be narrower than the two ends connected to the inner tube 110. Further, for providing preferable guide function and clamp force to pins in varied lengths, the amount of the spring elements 114 is preferably 3, which achieves better effect of guidance and balance. Nevertheless, the amount of the spring elements 114 can be 2 or other amount in consideration of special limitation or the size of the pin.

Figure 6:
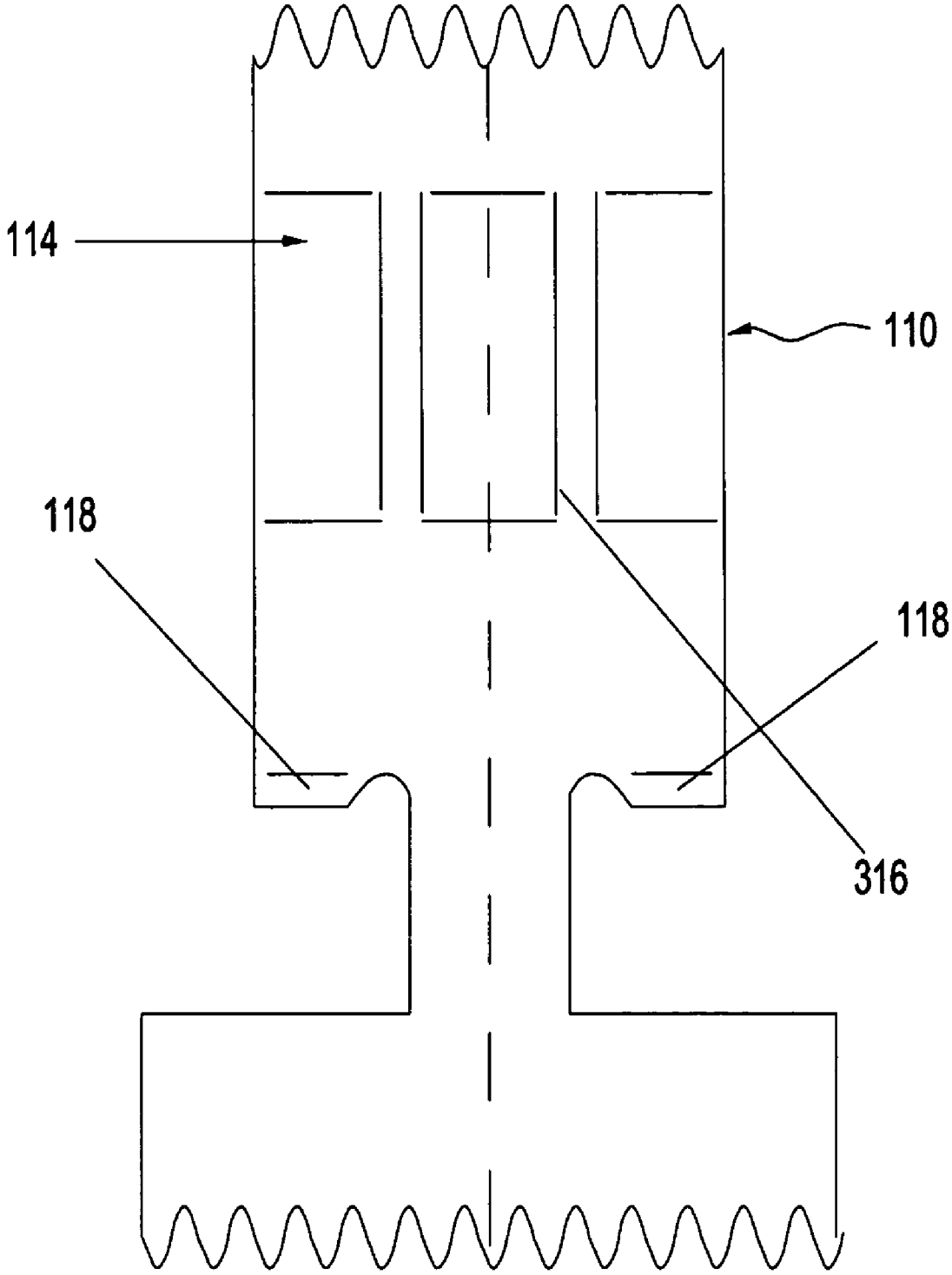
FIG. 6 is a partial expanded view of the female terminal of a socket connector according to a sixth preferred embodiment of the present invention.

Please refer to FIG. 6 for a sixth preferred embodiment of the present invention. In can be seen in the drawing that the disclosed female terminal 100 primarily comprises an attachment portion 102, a contact portion 104, a neck 106, an outer barrel 108, an inner tube 110, a folded part 112, a plurality of spring elements 114, a plurality of biasing section 316 and a diameter shrinking part 118.

The female terminal 100 is formed in one-piece construction by pressing a metal sheet in a mold and has the contact portion 104, the attachment portion 102 distant from the contact portion 104, and the neck 106 for joining the contact portion 104 and the attachment portion 102. The attachment portion 102 functions for connecting a conductive wire, while the contact portion 104 permits a slender pin to plug in so as to connect and clamp the pin and establish conductive communication with the pin. The inner tube 110 of the contact portion 104 has a plurality of spring elements 114 extending axially. Each of the spring elements 114 has the end near the entrance of the contact portion 104 and the end distant from the entrance of the contact portion 104 connected to the inner wall of the inner tube 110, and has the opposite sides separated from the inner wall of the inner tube 110 with a slit respectively. Alternatively, each said slit may be further extended into the form of an opening. Since the opposite sides of the spring elements 114 are not connected to the inner tube 110, the middle portions of the spring elements 114 can provide relatively better elasticity and deformability. The middle portions of the spring elements 114 may be firstly formed as biasing sections 316 facing toward the inner tube axis by a tool so that after a pin is plugged into the female terminal 100, the biasing sections 316 can provide appropriate guide function and clamp force to the pin.

Foresaid plural spring elements 114, the inner tube 110 and outer barrel 108 are formed as one piece from a single metal sheet by means of, for instance, pressing method. The inner tube 110 has one end connected with the neck 106 directly and has the opposite end connected with the outer barrel 108 via a folded part 112. The outer barrel 108 is shorter than the inner tube 110. A diameter shrinking part 118 is further provided with the outer barrel 108 and the contact portion 104 near the contact pin plug-in entrance for improving the assembly to the socket connector.

In addition the strip shape, the spring element 114 can also be formed into a trapezoid shape with one end broader that the opposite end or a shape with middle concaved profile as long as the biasing section 316 facing toward the inner tube axis can be formed at the middle portion of the spring element 114 so as to provide appropriate guide function and clamp force to the pin. Hence, on the spring element 114, the biasing section 316 may be wider than the two ends connected to the inner tube 110. Alternatively, the biasing section 316 may be narrower than the two ends connected to the inner tube 110. Further, for providing preferable guide function and clamp force to pins in varied lengths, the amount of the spring elements 114 is preferably 3, which achieves better effect of guidance and balance. Nevertheless, the amount of the spring elements 114 can be 2 or other amount in consideration of special limitation or the size of the pin.

The present invention further provides a seventh preferred embodiment of the present invention, which is a socket comprising an isolating housing and a plurality of female terminals regularly arranged therein, wherein the female terminals are accommodated in the isolating housing. Each said female terminal 100 primarily comprises an attachment portion 102, a contact portion 104, a neck 106, an outer barrel 108, and an inner tube 110 and possesses the characters as disclosed in the first through sixth preferred embodiments.

The present further provides an eighth preferred embodiment of the present invention, which is a socket comprising an isolating housing and a plurality of female terminals regularly arranged therein, wherein the female terminals are accommodated in the isolating housing. Each said female terminal 100 primarily comprises an attachment portion 102, a contact portion 104, a neck 106, an outer barrel 108, and an inner tube 110 and possesses the characters as disclosed in the first through sixth preferred embodiments.

The present further provides a ninth preferred embodiment of the present invention, which is a socket comprising an isolating housing and a plurality of female terminals regularly arranged therein, wherein the female terminals are accommodated in the isolating housing. Each said female terminal 100 primarily comprises an attachment portion 102, a contact portion 104, a neck 106, an outer barrel 108, and an inner tube 110 and possesses the characters as disclosed in the first through sixth preferred embodiments.

The present further provides a tenth preferred embodiment of the present invention, which is a socket comprising an isolating housing and a plurality of female terminals regularly arranged therein, wherein the female terminals are accommodated in the isolating housing. Each said female terminal 100 primarily comprises an attachment portion 102, a contact portion 104, a neck 106, an outer barrel 108, and an inner tube 110 and possesses the characters as disclosed in the first through sixth preferred embodiments.

The present further provides an eleventh preferred embodiment of the present invention, which is a socket comprising an isolating housing and a plurality of female terminals regularly arranged therein, wherein the female terminals are accommodated in the isolating housing. Each said female terminal 100 primarily comprises an attachment portion 102, a contact portion 104, a neck 106, an outer barrel 108, and an inner tube 110 and possesses the characters as disclosed in the first through sixth preferred embodiments.

The present further provides a twelfth preferred embodiment of the present invention, which is a socket comprising an isolating housing and a plurality of female terminals regularly arranged therein, wherein the female terminals are accommodated in the isolating housing. Each said female terminal 100 primarily comprises an attachment portion 102, a contact portion 104, a neck 106, an outer barrel 108, and an inner tube 110 and possesses the characters as disclosed in the first through sixth preferred embodiments.

Although foresaid embodiments of the invention has been described in detail for purposes of illustration, it will be understood by one of ordinary skill in the art that numerous variations will be possible to the disclosed embodiments without going outside the scope of the invention as disclosed in the claims.

What is claimed is:

1. A female terminal in a socket connector, which is formed in one-piece construction from a metal sheet and comprises a contact portion and an attachment portion distant from the contact portion, wherein the attachment portion is set to attach to a wire core, while the contact portion is set to permit a pin to plug in and contact conductively, and a neck with a smaller diameter is provided between the contact portion and the attachment portion, wherein, the contact portion comprises an outer barrel and an inner tube, wherein the inner tube has one end connected with the neck directly and has the opposite end connected with the outer barrel via a folded part, and the outer barrel is shorter than the inner tube, wherein the inner tube has a plurality of spring elements extending axially, each having a biasing section toward the inner tube axis for matching the contact pin, in which each said spring element has the end distant from the biasing section connected to the inner tube and has the opposite end near the biasing section separated from the inner wall of the inner tube with a slit.

2. The female terminal in a socket connector of claim 1, wherein each biasing section of each spring element is near the plug-in entrance.

3. The female terminal in a socket connector of claim 2, wherein a diameter shrinking part is further provided with the outer barrel near the contact pin plug-in entrance.

4. The female terminal in a socket connector of claim 2, wherein the spring element is formed into a strip shape.

5. The female terminal in a socket connector of claim 2, wherein the spring element is formed into a trapezoid shape and the biasing section is wider than the portion of the spring element connected to the inner tube.

6. The female terminal in a socket connector of claim 2, wherein the spring element is formed into a trapezoid shape and the biasing section is narrower than the portion of the spring element connected to the inner tube.

7. The female terminal in a socket connector of claim 1, wherein each biasing section of each spring element is distant from the plug-in entrance.

8. The female terminal in a socket connector of claim 7, wherein a diameter shrinking part is further provided with the outer barrel near the contact pin plug-in entrance.

9. The female terminal in a socket connector of claim 7, wherein the spring element is formed into a strip shape.

10. The female terminal in a socket connector of claim 7, wherein the spring element is formed into a trapezoid shape and the biasing section is wider than the portion of the spring element connected to the inner tube.

11. The female terminal in a socket connector of claim 7, wherein the spring element is formed into a trapezoid shape and the biasing section is narrower than the portion of the spring element connected to the inner tube.

12. A socket connecter comprising an isolating housing and a plurality of female terminals regularly arranged therein, wherein the female terminal is formed in one-piece construction from a metal sheet and comprises a contact portion and an attachment portion distant from the contact portion, wherein the attachment portion is set to attach to a wire core, while the contact portion is set to permit a pin to plug in and contact conductively, and a neck with a smaller diameter is provided between the contact portion and the attachment portion, wherein, the contact portion comprises an outer barrel and an inner tube, wherein the inner tube has one end connected with the neck directly and has the opposite end connected with the outer barrel via a folded part, and the outer barrel is shorter than the inner tube, in which the inner tube has a plurality of spring elements extending axially, each having a biasing section toward the inner tube axis for matching the contact pin, wherein each said spring element has the end distant from the biasing section connected to the inner tube and has the opposite end near the biasing section separated from the inner wall of the inner tube with a slit.

13. The socket connector of claim 12, wherein each biasing section of each spring element is near the plug-in entrance.

14. The socket connector of claim 13, wherein a diameter shrinking part is further provided with the outer barrel near the contact pin plug-in entrance.

15. The socket connector of claim 13, wherein the spring element is formed into a strip shape.

16. The socket connector of claim 13, wherein the spring element is formed into a trapezoid shape and the biasing section is wider than the portion of the spring element connected to the inner tube.

17. The socket connector of claim 13, wherein the spring element is formed into a trapezoid shape and the biasing section is narrower than the portion of the spring element connected to the inner tube.

18. The socket connector of claim 12, wherein each biasing section of each spring element is distant from the plug-in entrance.

19. The socket connector of claim 18, wherein a diameter shrinking part is further provided with the outer barrel near the contact pin plug-in entrance.

20. The socket connector of claim 18, wherein the spring element is formed into a strip shape.

21. The socket connector of claim 18, wherein the spring element is formed into a trapezoid shape and the biasing section is wider than the portion of the spring element connected to the inner tube.

22. The socket connector of claim 18, wherein the spring element is formed into a trapezoid shape and the biasing section is narrower than the portion of the spring element connected to the inner tube.

* * * * *